US011927410B2

(12) United States Patent
Kunsky

(10) Patent No.: US 11,927,410 B2
(45) Date of Patent: Mar. 12, 2024

(54) FIREARM SUPPRESSOR WITH REMOTE CHAMBER

(71) Applicant: Jacob Kunsky, Bruneau, ID (US)

(72) Inventor: Jacob Kunsky, Bruneau, ID (US)

( * ) Notice: Subject to any disclaimer, the term of this patent is extended or adjusted under 35 U.S.C. 154(b) by 21 days.

(21) Appl. No.: 17/486,180

(22) Filed: Sep. 27, 2021

(65) Prior Publication Data

US 2023/0100384 A1 Mar. 30, 2023

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 430,210 A * 6/1890 Maxim ..... F41A 19/03 138/40
984,750 A * 2/1911 Craven ..... F41A 21/30 89/14.4
1,066,898 A * 7/1913 Gray ..... F41A 21/30 181/223
1,207,264 A * 12/1916 Bailey ..... F41A 21/30 89/14.4
1,877,118 A * 9/1932 Barnes ..... F41A 25/02 126/41 R
1,901,138 A * 3/1933 Barnes ..... F41A 21/30 89/14.3
2,449,571 A * 9/1948 Walker ..... F41A 21/30 89/14.4
2,935,912 A * 5/1960 Hartley ..... F41A 13/12 42/76.02
3,667,570 A * 6/1972 WerBell, III ..... F41A 21/30 89/14.4
3,710,679 A * 1/1973 Werbell, III ..... F41A 21/30 89/14.4
4,576,083 A * 3/1986 Seberger, Jr. ..... F01N 1/08 89/14.4
4,907,488 A * 3/1990 Seberger ..... F41A 21/30 89/14.4
4,974,489 A * 12/1990 Fishbaugh ..... F41A 21/30 89/14.4

(Continued)

FOREIGN PATENT DOCUMENTS

CN 111895853 A * 11/2020 ..... F41A 21/36

*Primary Examiner* — Joshua E Freeman
*Assistant Examiner* — Benjamin S Gomberg
(74) *Attorney, Agent, or Firm* — Parsons Behle & Latimer

(57) ABSTRACT

Apparatuses and systems regarding a firearm suppressor having a remote chamber. The suppressor includes a base configured to be connected to a firearm. The firearm suppressor includes one or more baffles, an end cap, and may include a housing. An initial chamber is positioned between the base and a first baffle. A remote chamber is positioned exterior of the housing and is in fluid communication with the initial chamber. The initial chamber has a first volume and the remote chamber has a second volume, which may be substantially equal to the first volume, more than twice as large as the first volume, or may even be greater than 100 liters. The remote chamber may be connected to the initial chamber via a flexible tube. The remote chamber may be connected to a portion of a firearm, connected to a vehicle, or may be wearable.

19 Claims, 7 Drawing Sheets

(56) References Cited

U.S. PATENT DOCUMENTS

| | | | | |
|---|---|---|---|---|
| 6,192,612 | B1 * | 2/2001 | Maier | F41A 1/04 89/14.6 |
| 6,374,718 | B1 * | 4/2002 | Rescigno | F41A 21/30 89/14.4 |
| 8,397,862 | B2 * | 3/2013 | Shand | F41A 21/30 89/14.3 |
| 10,337,819 | B1 * | 7/2019 | Stark | F41A 21/30 |
| 10,890,403 | B2 * | 1/2021 | Petersen | F42B 39/20 |
| 2018/0313626 | A1 * | 11/2018 | Tomczak | F41A 21/325 |
| 2019/0063859 | A1 * | 2/2019 | Gilpin | F41A 21/30 |
| 2019/0249943 | A1 * | 8/2019 | Barcherini | F41A 21/30 |
| 2019/0293377 | A1 * | 9/2019 | Barcherini | F41A 21/30 |
| 2020/0025495 | A1 * | 1/2020 | Petersen | F42B 39/20 |
| 2020/0263943 | A1 * | 8/2020 | Kingsbury | F41A 5/26 |
| 2021/0071979 | A1 * | 3/2021 | Plunkett, Jr. | F41A 21/30 |
| 2022/0404111 | A1 * | 12/2022 | Hodowanec | F41A 21/30 |

* cited by examiner

FIREARM SUPPRESSOR WITH REMOTE CHAMBER

FIELD OF THE DISCLOSURE

The examples described herein relate to apparatuses, systems, and methods for a firearm suppressor having a remote chamber.

BACKGROUND

Description of the Related Art

A firearm suppressor is a device mounted or otherwise attached to the muzzle of a firearm and, through selective use of baffles or other gas-redirection apparatus, operates to diminish the report (as measured in decibels) of a firearm following discharge. By reducing the report of a discharging firearm, suppressors reduce or mitigate hearing damage or loss otherwise resulting from repeated exposure to firearm discharges.

A firearm suppressor typically includes a plurality of baffles positioned within a housing. A projectile path passes from the first end of the suppressor, which is attached to a firearm, through each of the baffles, and through an end cap attached to the housing at the second end of the suppressor. The discharge of a firearm to which a suppressor is attached causes a buildup in gas pressure within the suppressor. It is believed that the pressure buildup is the greatest in the initial chamber (i.e., the chamber between the first baffle and the first end of the firearm suppressor) of the suppressor. The pressure buildup can cause the cycling of the firearm bolt to increase. The increased speed of the bolt may jam the firearm, cause increased wear and tear on the bolt carrier group, and/or may increase the recoil. Additionally, the discharge of a firearm connected to a suppressor causes an increase in temperature within the suppressor with repeated discharges causing additional heat build-up within the suppressor. It is believed that the temperature may be the highest in the initial chamber in comparison to other chambers within the suppressor. Other disadvantages may exist.

SUMMARY

The present disclosure is directed to apparatus, systems, and methods for a firearm suppressor having a remote chamber.

One example of the present disclosure is a firearm suppressor. The firearm suppressor includes a base that is configured to be connected to a barrel of a firearm. The base includes a projectile pathway through the base. The firearm suppressor includes one or more baffles each that include a central aperture. The firearm suppressor includes an end cap having a central opening and a housing connected between the base and the end cap. The one or more baffles are positioned within the housing. The firearm suppressor includes an initial chamber that is positioned between the base and a first baffle of the one or more baffles. The firearm suppressor includes a remote chamber positioned exterior of the housing. The remote chamber is in fluid communication with the initial chamber.

The initial chamber has a first volume and the remote chamber has a second volume. The first volume may be substantially equal to the second volume. The second volume may be more than twice as large as the first volume. The second volume may be greater than 100 liters. The remote chamber may be connected to the initial chamber via a flexible tube. The remote chamber may be connected to a portion of a firearm. The remote chamber may be positioned within a stock of a firearm. The remote chamber may be connected to a vehicle. The vehicle may be a watercraft. The remote chamber may be in fluid communication with an exhaust system of a vehicle. The remote chamber may be in fluid communication with the exhaust system upstream of a muffler.

The remote chamber may be wearable. The remote chamber may be a first remote chamber and the firearm suppressor may include a second remote chamber positioned exterior of the housing with the second remote chamber being in fluid communication with the initial chamber. The remote chamber may include a relief valve. The relieve valve may be configured to release gas from the remote chamber when a pressure within the remote chamber exceeds a predetermined pressure. The predetermined pressure may be approximately 25 pound-force per square inch (PSI) to approximately 50 PSI.

One embodiment of the present disclosure is a firearm suppressor. The firearm suppressor includes a base configured to be connected to a barrel of a firearm. The base includes a first projectile pathway through the base. The firearm suppressor includes one or more baffles each that include a central aperture. The firearm suppressor includes an end cap having a central opening. The one or more baffles are positioned between the base and the end cap. The firearm suppressor includes an initial chamber positioned between the base and a first baffle of the one or more baffles. The firearm suppressor includes a remote chamber in fluid communication with the initial chamber. The remote chamber is not positioned between the base and the end cap.

The remote chamber may include an adapter positioned between the base and the one or more baffles. The adapter may include a second projectile pathway through the adapter that may be aligned with the first projectile pathway. The initial chamber may be positioned between the adapter and the first baffle of the one or more baffles. The remote chamber may be connected to the initial chamber via a tube. The remote chamber may be connected to a portion of a firearm via an accessory rail.

One embodiment of the disclosure is a firearm suppressor. The firearm suppressor includes one or more baffles. The one or more baffles each include a central aperture configured to be aligned with a centerline of a barrel of a firearm. The firearm suppressor includes an initial chamber. The initial chamber being positioned between a first baffle of the one or more baffles and a muzzle end of the barrel of the firearm. The firearm suppressor includes an exterior port in fluid communication with the initial chamber, wherein the exterior port is not aligned with the centerline of the barrel of the firearm. The firearm suppressor may include a remote chamber in fluid communication with the exterior port.

Figure 1:
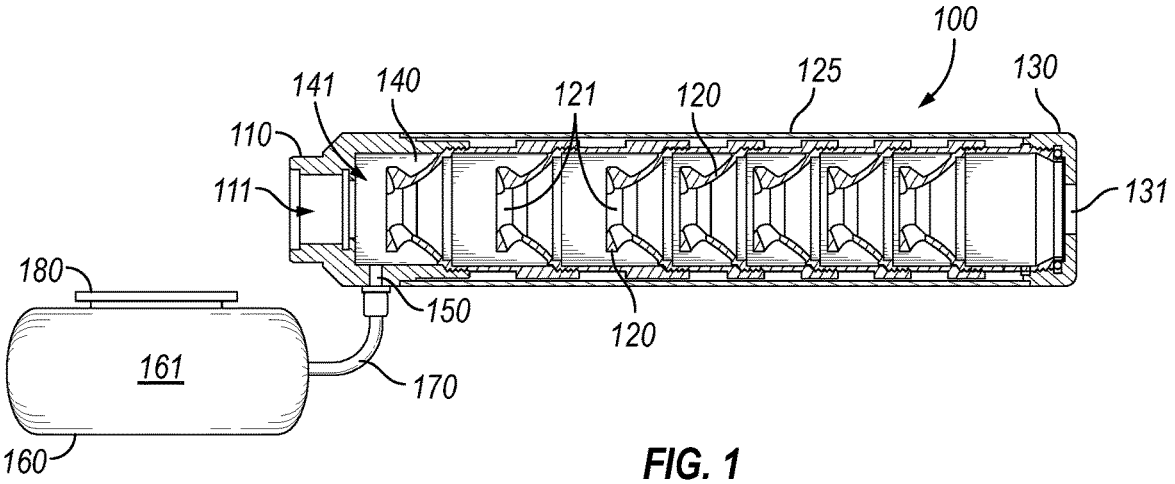
FIG. 1 is a schematic of an embodiment of a firearm suppressor having a remote chamber.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 is a schematic of a firearm suppressor 100 that includes a remote chamber 160. The firearm suppressor 100 is configured to be attached to a firearm to reduce the noise during the discharge of the firearm as would be appreciated by one of ordinary skill in the art having the benefit of this disclosure. The firearm suppressor 100 includes a base 110 and an end cap 130 with a plurality of baffles 120 positioned between the base 110 and the end cap 130. The base 110 is configured to attach the firearm suppressor 100 to the muzzle end of a firearm. The baffles 120 may be positioned within a housing 125. The firearm suppressor 100 includes a projectile path through the length of the firearm suppressor 100. For example, the base 110 includes an opening, or first projectile pathway 111, each of the baffles includes a central aperture 121, and the end cap 130 includes a central opening 131 that enables a discharged bullet to traverse the firearm suppressor 100 along the centerline of the firearm suppressor 100 as would be appreciated by one of ordinary skill in the art having the benefit of this disclosure.

The firearm suppressor 100 includes a remote chamber 160 that is in fluid communication with an initial chamber 140 of the firearm suppressor 100. The initial chamber 140 is positioned between the base 110 and the first baffle 120. It is believed that the highest pressure increase as well as highest temperature increase is exhibited in the initial chamber 140 when a firearm attached to the firearm suppressor 100 is discharged. The remote chamber 160 is in fluid communication with the initial chamber 140 via tubing 170. Tubing 170 may be flexible or rigid as would be appreciated by one of ordinary skill in the art having the benefit of this disclosure. The tubing 170 is connected to an exterior port 150 in the firearm suppressor 100. The exterior port 150 provides communication between the initial chamber 140 and the remote chamber 160 via the tubing 170. The exterior port 150 may be through the base 110, the housing 125, or both the base 110 and the housing 125 of the firearm suppressor 100.

The remote chamber 160 is considered "remote" as it is not located within the housing 125 of the firearm suppressor 100 and/or is not positioned between the base 110 and the end cap 130 if the firearm suppressor 100 does not includes a housing 125. A chamber not aligned with a centerline of the firearm suppressor 100 may be considered a remote chamber. The initial chamber 140 has a first volume 141. It is believed that the size of the initial chamber 140 affects the effectiveness of the firearm suppressor 100. In other words, the larger the volume 141 of the initial chamber 140, the better the suppressor 100 may suppress the noise of the discharge of the firearm. However, the enlarging the initial chamber 140 may make the suppressor 100 to cumbersome, large, and/or heavy such that attaching the suppressor 100 to an end of a firearm and may have negative effects on the operator's accuracy and/or ability to use the firearm in tactical situations.

The addition of a remote chamber 160 having a second volume 161 enables the effective volume of the initial chamber 140 to be enlarged without adding to the length, size, and/or weight of the suppressor being added to the end of the firearm. For example, the remote chamber 160 may be located elsewhere than the muzzle end of the firearm. The second volume 161 is filled with a gas, such as air. Although the second volume 161 is in fluid communication with the first volume 141, the initial chamber 140 and the remote chamber 160 may both only contain air and may not include another fluid.

The remote chamber 160 may include a profile 180 that enables the remote chamber 160 to be attached to an accessory rail. In addition to enlarging the effective volume of the initial chamber 140 to potentially reduce the sound of a discharge, the remote chamber 160 may also act as a heat sink to pull heat away from the main body of the firearm suppressor 100 and into the remote chamber 160. The remote chamber 160 may also decrease the pressure increase within the initial chamber 140 due to the second volume 161 of the remote chamber 160 that is in fluid communication with the first volume 141 of the initial chamber 140 via the tubing 170. The decrease in pressure may reduce cycling issues such as increased bolt speed due to the use of a firearm suppressor 100 without the remote chamber 160.

Figure 2:
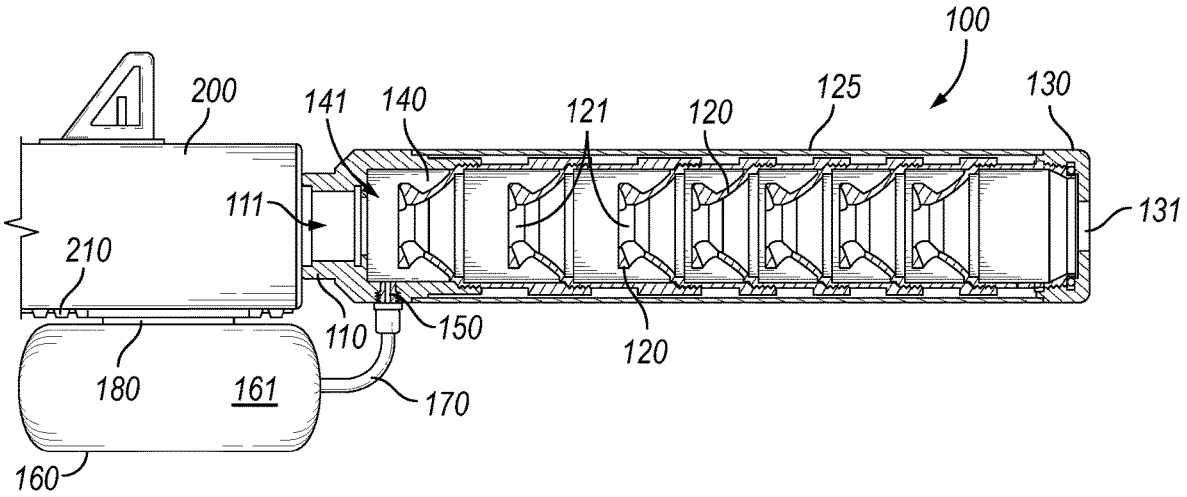
FIG. 2 is a schematic of an embodiment of a firearm suppressor having a remote chamber connected to a firearm.

FIG. 2 is a schematic of a firearm suppressor 100 that includes a remote chamber 160 with the remote chamber 160 being attached to a portion of a firearm 200. The remote chamber 160 may include a profile 180 that enables the remote chamber 160 to be attached to an accessory rail 210 on a firearm 200. The accessory rail 210 may be placed on various locations of the firearm 200 as would be appreciated by one of ordinary skill in the art having the benefit of this disclosure. For example, the accessory rail 210 may be positioned on a bottom portion of a foregrip or on a side portion of a foregrip.

Figure 3:
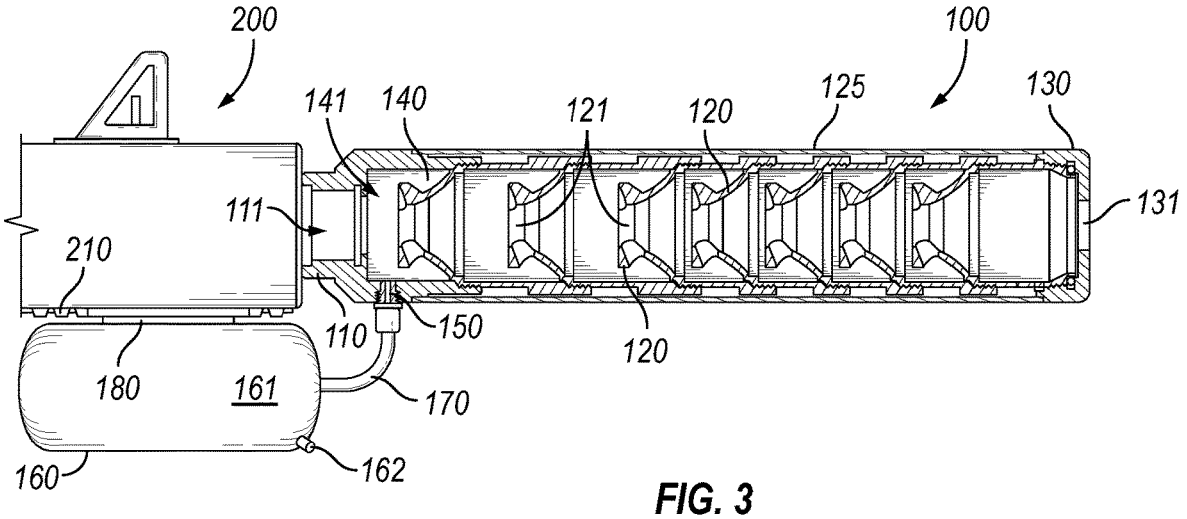
FIG. 3 is a schematic of an embodiment of a firearm suppressor having a remote chamber connected to a firearm with the remote chamber including a relief valve.

FIG. 3 is a schematic of a firearm suppressor 100 that includes a remote chamber 160 with the remote chamber 160 being attached to a portion of a firearm 200. The firearm suppressor 100 is configured to be attached to a firearm to reduce the noise during the discharge of the firearm as would be appreciated by one of ordinary skill in the art having the benefit of this disclosure. The firearm suppressor 100 includes a base 110 and an end cap 130 with a plurality of baffles 120 positioned between the base 110 and the end cap 130. The base 110 is configured to attach the firearm suppressor 100 to the muzzle end of a firearm. The baffles 120 may be positioned within a housing 125. The firearm suppressor 100 includes a projectile path through the length of the firearm suppressor 100. For example, the base 110 includes an opening, or first projectile pathway 111, each of the baffles includes a central aperture 121, and the end cap 130 includes a central opening 131 that enables a discharged bullet to traverse the firearm suppressor 100 along the centerline of the firearm suppressor 100 as would be appreciated by one of ordinary skill in the art having the benefit of this disclosure The firearm suppressor 100 includes a remote chamber 160 that is in fluid communication with an initial chamber 140 of the firearm suppressor 100 via tubing 170. The tubing 170 may be flexible or rigid as would be appreciated by one of ordinary skill in the art having the benefit of this disclosure. The tubing 170 is connected to an exterior port 150 in the firearm suppressor 100. The exterior port 150 may be through the base 110 as shown in FIG. 3. The exterior port 150 provides communication between the initial chamber 140 and the remote chamber 160 via the tubing 170.

The remote chamber 160 may include a relief valve 162. The relief valve 162 is configured to release gas from within the remote chamber 160 when a predetermined pressure is reached within the volume 161 of the remote chamber 160. The predetermined pressure may be between 25 pound-force per square inch (PSI) and 50 PSI. The relief valve 162 may prevent the pressure within the volume 161 of the remote chamber 160 from increasing too much. The release of pressure via the relieve valve 162 may also decrease the temperature within the volume 161 of the remote chamber 160.

Figure 4:
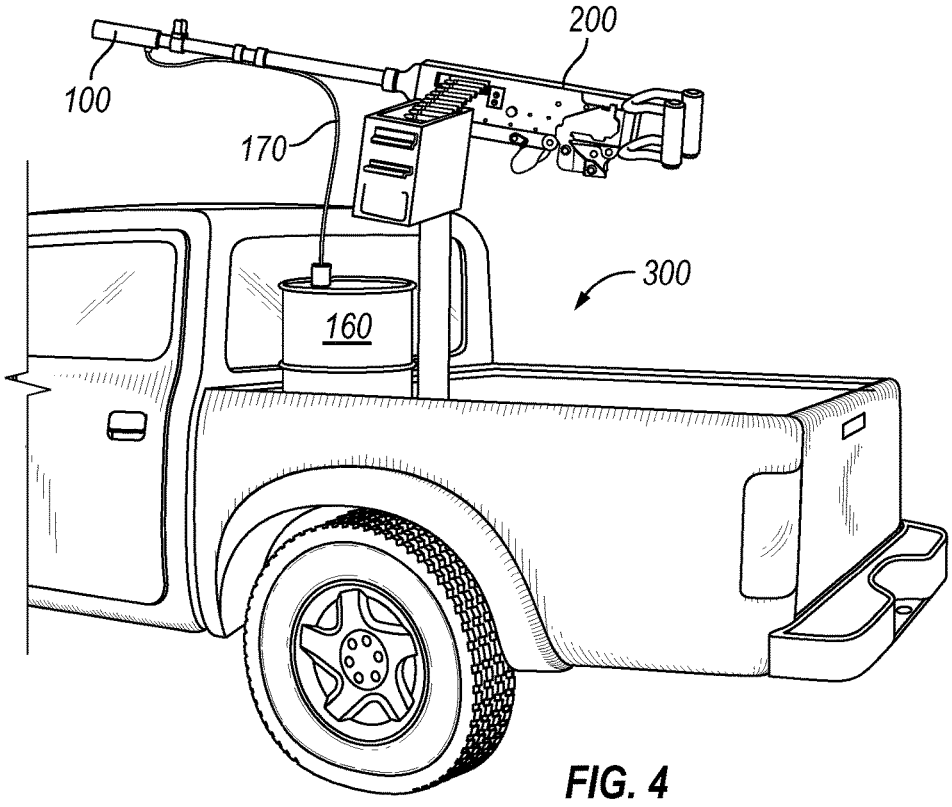
FIG. 4 is a schematic of an embodiment of a firearm suppressor having a remote chamber connected to a vehicle.

FIG. 4 is a schematic of an embodiment of a firearm suppressor 100 having a remote chamber 160 connected to, or positioned in, a vehicle 300. A firearm 200, which may be a vehicle-mounted firearm, includes a suppressor 100 configured to suppress the sound of the discharge of the firearm 200. The remote chamber 160 is connected to the suppressor 100 via a pathway 170, which may be flexible tubing. The remote chamber 160 may have a volume of 100 liters or more. For example, the remote chamber 160 may be a 55-gallon drum, which has a volume of 200 liters. The vehicle may be, but is not limited to, an automobile, aircraft, watercraft, a military vehicle, a law enforcement vehicle, or the like.

Figure 5:
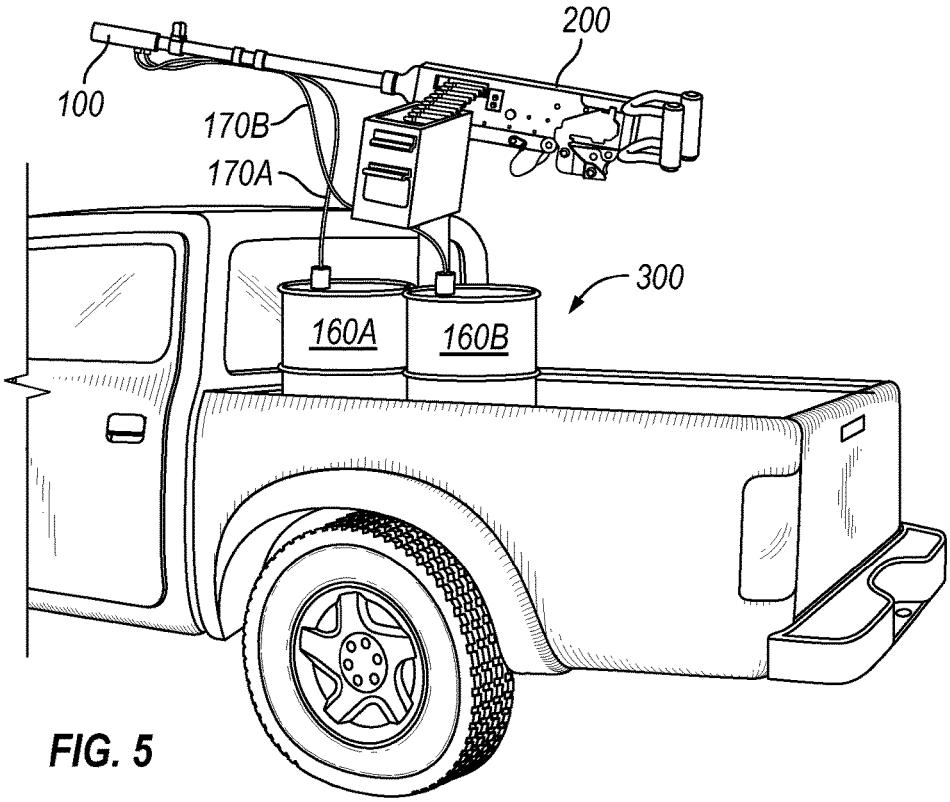
FIG. 5 is a schematic of an embodiment of a firearm suppressor having two remote chambers connected to a vehicle.

FIG. 5 is a schematic of an embodiment of a firearm suppressor 100 having a first remote chamber 160A connected to, or positioned in, a vehicle 300 and a second remote chamber 160B connected to, or positioned in, a vehicle 300. A firearm 200, which may be a vehicle-mounted firearm, includes a suppressor 100 configured to suppress the sound of the discharge of the firearm 200. The first remote chamber 160 is connected to the suppressor 100 via a first pathway 170A, which may be flexible tubing, rigid tubing, or the like. Likewise, the second remote chamber 160B is connected to the suppressor 10 via a second pathway 170B, which may be flexible tubing, rigid tubing, or the like. Each of the remote chambers 160A, 160B may have a volume of 100 liters or more. For example, the remote chambers 160A, 160B may be 55-gallon drums. The number of remote chambers 160A, 160B may be varied and may be more or less that two as would be appreciated by one of ordinary skill in the art having the benefit of this disclosure.

Figure 6:
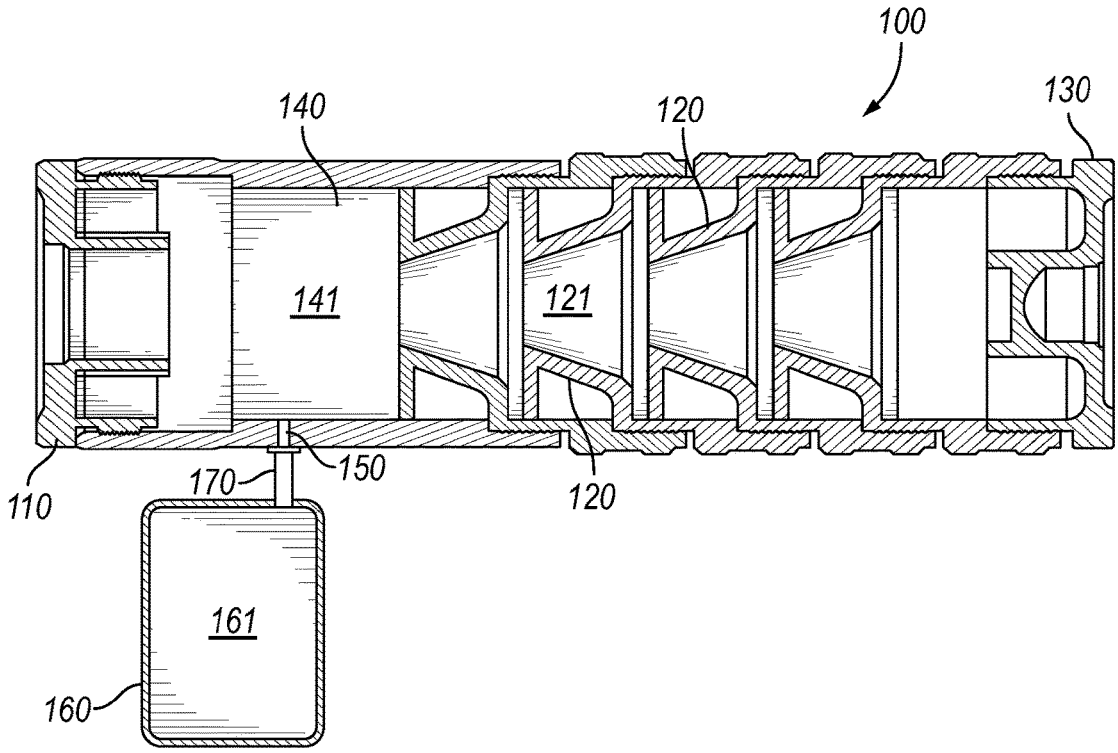
FIG. 6 is a schematic of an embodiment of a firearm suppressor having a remote chamber having a volume that is approximately equal to the volume of the initial chamber of the firearm suppressor.

FIG. 6 is a schematic of a firearm suppressor 100 that includes a remote chamber 160. The remote chamber 160 is in fluid communication with the initial chamber 140 of the firearm suppressor 100 via tubing 170. Tubing 170 may be flexible or rigid as would be appreciated by one of ordinary skill in the art having the benefit of this disclosure. The tubing 170 is connected to an exterior port 150 in the firearm suppressor 100. The exterior port 150 provides communication between the initial chamber 140 and the remote chamber 160 via the tubing 170. The remote chamber 160 has a second volume 161 that is approximately equal to the first volume 141 of the initial chamber 140. In other words, the addition of the remote chamber 160 basically doubles the volume of the initial chamber 140 to better suppress the discharge of a firearm connected to the firearm suppressor 100.

Figure 7:
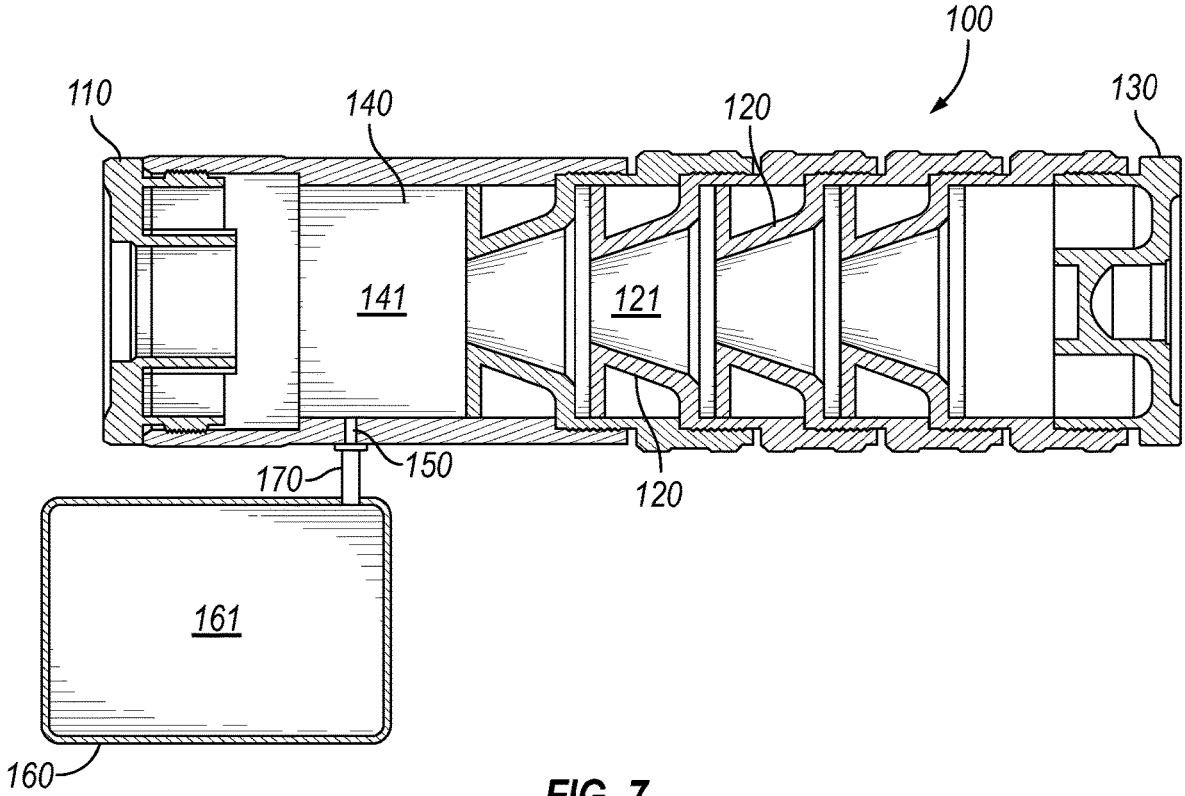
FIG. 7 is a schematic of an embodiment of a firearm suppressor having a remote chamber having a volume that is approximately twice as large as the volume of the initial chamber of the firearm suppressor.

FIG. 7 is a schematic of a firearm suppressor 100 that includes a remote chamber 160. The remote chamber 160 is in fluid communication with the initial chamber 140 of the firearm suppressor 100 via tubing 170. Tubing 170 may be flexible or rigid as would be appreciated by one of ordinary skill in the art having the benefit of this disclosure. The tubing 170 is connected to an exterior port 150 in the firearm suppressor 100. The exterior port 150 provides communication between the initial chamber 140 and the remote chamber 160 via the tubing 170. The remote chamber 160 has a second volume 161 that is approximately equal to twice as large as the first volume 141 of the initial chamber 140. In other words, the addition of the remote chamber 160 basically triples the volume of the initial chamber 140 to better suppress the discharge of a firearm connected to the firearm suppressor 100.

Figure 8:
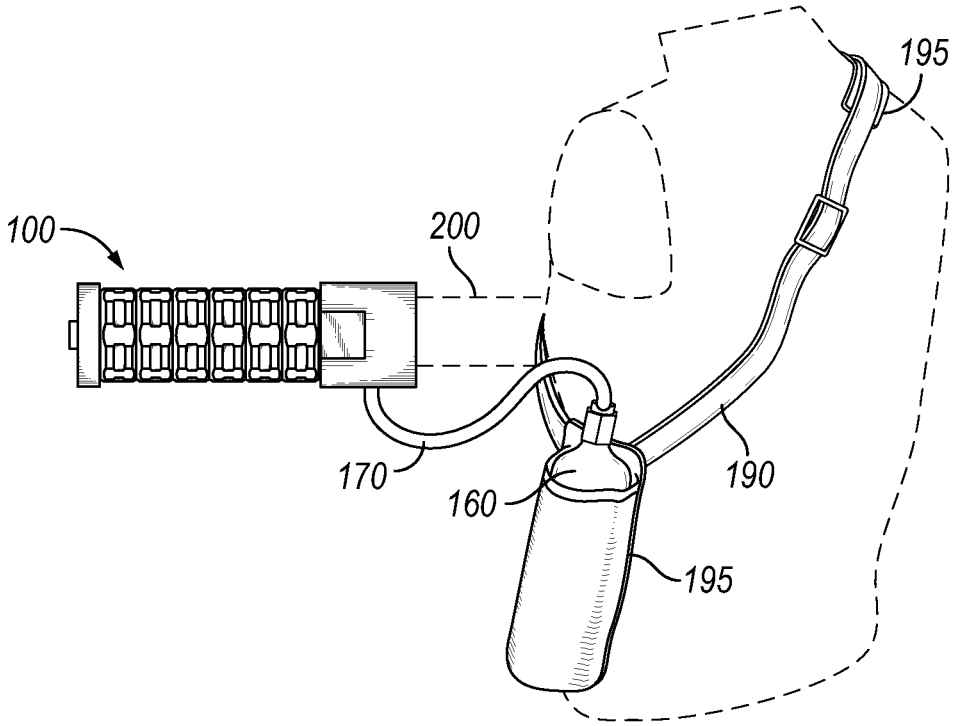
FIG. 8 is a schematic of an embodiment of a firearm suppressor having a remote chamber that is wearable.

FIG. 8 is a schematic of a firearm suppressor 100 that includes a remote chamber 160 that is wearable. The remote chamber 160 is configured to be worn by a user. For example, the remote chamber 160 may include a strap 190 and a pad 195. The strap 190 may enable the remote chamber 160 to be connected to various portions of a user. The pad 195 may make the remote chamber 160 more comfortable to wear and/or may provide protection against heat built up within the volume 161 of the remote chamber 160.

Figure 9:
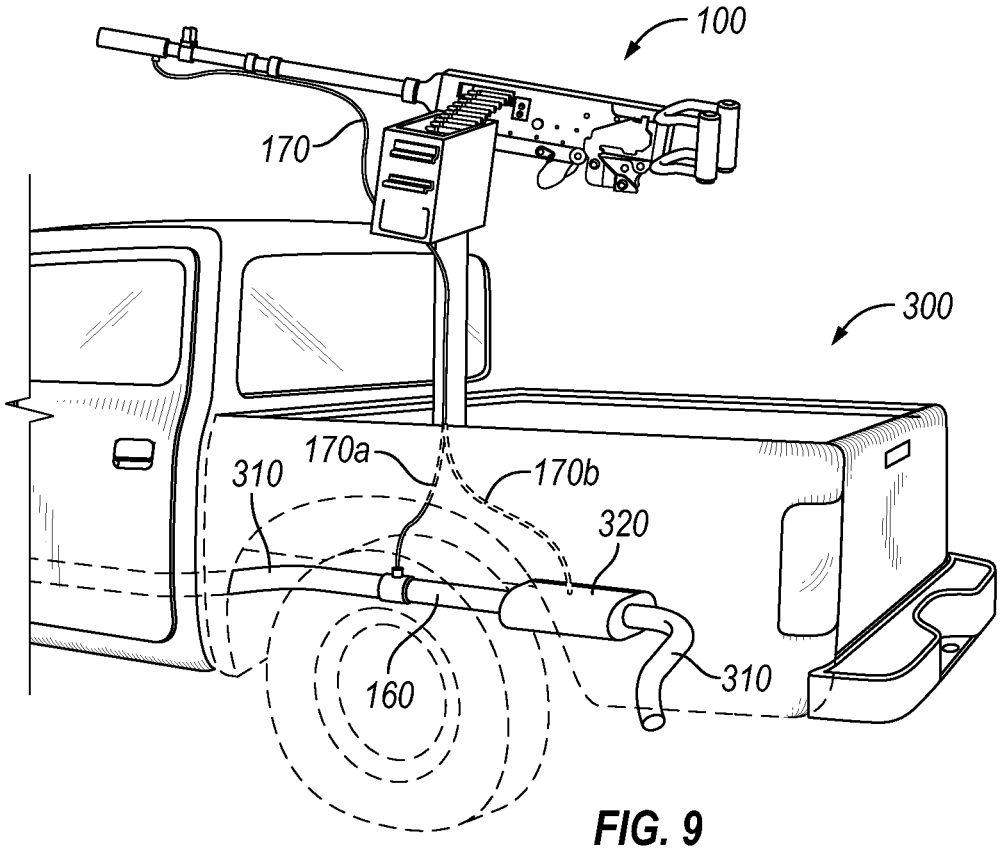
FIG. 9 is a schematic of an embodiment of a firearm suppressor having a remote chamber that is in fluid communication with an exhaust system of a vehicle.

FIG. 9 is a schematic of a firearm suppressor 100 that has a remote chamber 160 that is part of an exhaust system 310 of a vehicle 300. Tubing 170A from the firearm suppressor 100 may provide fluid communication between the volume of the initial chamber 140 and the exhaust system 310 upstream of a muffler 320. The muffler 320 may further suppress the discharge of a firearm connected to the firearm suppressor 100. Alternatively, tubing 170B may provide fluid communication between the volume of the initial chamber 140 directly to a muffler 320 of an exhaust system 310. In some embodiments, tubing 170A, 170B may provide fluid communication between the volume of the initial chamber 140 with both a portion of an exhaust system 310 and a muffler 320 of the exhaust system 310.

Figure 10:
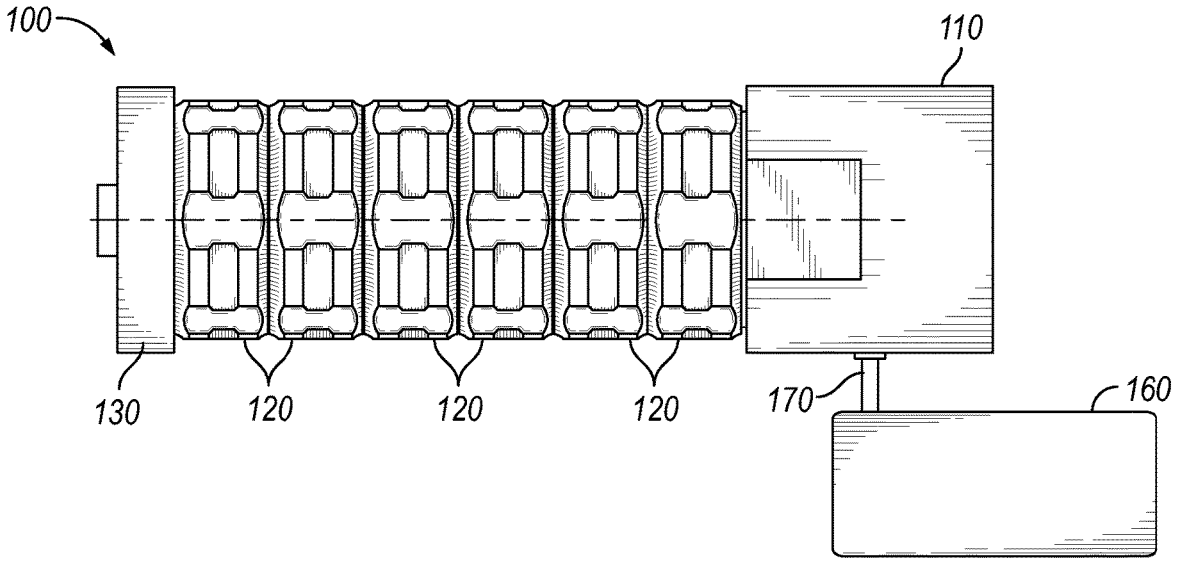
FIG. 10 is schematic of an embodiment of a firearm suppressor having a remote chamber.

FIG. 10 is a schematic of a firearm suppressor 100 that includes a remote chamber 160. The firearm suppressor 100 is configured to be attached to a firearm to reduce the noise during the discharge of the firearm as would be appreciated by one of ordinary skill in the art having the benefit of this disclosure. The firearm suppressor 100 includes a base 110 and an end cap 130 with a plurality of baffles 120 positioned between the base 110 and the end cap 130. The base 110 is configured to attach the firearm suppressor 100 to the muzzle end of a firearm. The firearm suppressor 100 includes a projectile path through the length of the firearm suppressor 100 as would be appreciated by one of ordinary skill in the art having the benefit of this disclosure.

The firearm suppressor 100 includes a remote chamber 160 that is in fluid communication with an initial chamber of the firearm suppressor 100. The initial chamber is positioned between the base 110 and the first baffle 120. It is believed that the highest pressure increase as well as highest temperature increase is exhibited in the initial chamber when a firearm 200 attached to the firearm suppressor 100 is discharged. The remote chamber 160 is in fluid communication with the initial chamber via tubing 170. Tubing 170 may be flexible or rigid as would be appreciated by one of ordinary skill in the art having the benefit of this disclosure. The tubing 170 is connected to an exterior port 150 in the firearm suppressor 100. The exterior port 150 provides communication between the initial chamber and the remote chamber 160 via the tubing 170. The exterior port 150 may be through the side of the base 110 of the firearm suppressor 100.

The remote chamber 160 is considered "remote" as it is not located positioned between the base 110 and the end cap 130 of the firearm suppressor 100. The initial chamber has a first volume. It is believed that the size of the initial chamber effects the effectiveness of the firearm suppressor 100. In other words, the larger the volume of the initial chamber, the better the suppressor 100 may suppress the noise of the discharge of the firearm 200. However, the enlarging the initial chamber may make the suppressor 100 to cumbersome, large, and/or heavy such that attaching the suppressor 100 to an end of a firearm 200 may have negative effects on the operator's accuracy and/or ability to use the firearm 200 in tactical situations.

The addition of a remote chamber 160 having a second volume enables the effective volume of the initial chamber to be enlarged without adding to the length, size, and/or weight of the suppressor 100 being added to the end of the firearm 200. For example, the remote chamber 160 may be located elsewhere than the muzzle end of the firearm 200 as discussed herein. In addition to enlarging the effective volume of the initial chamber to potentially reduce the sound of a discharge, the remote chamber 160 may also act as a heat sink to pull heat away from the main body of the firearm suppressor 100 and into the remote chamber 160. The remote chamber 160 may also decrease the pressure increase within the initial chamber due to the second volume of the remote chamber 160 that is in fluid communication with the first volume of the initial chamber via the tubing 170. The decrease in pressure may reduce cycling issues such as increased bolt speed due to the use of a firearm suppressor 100 without the remote chamber 160.

Figure 11:
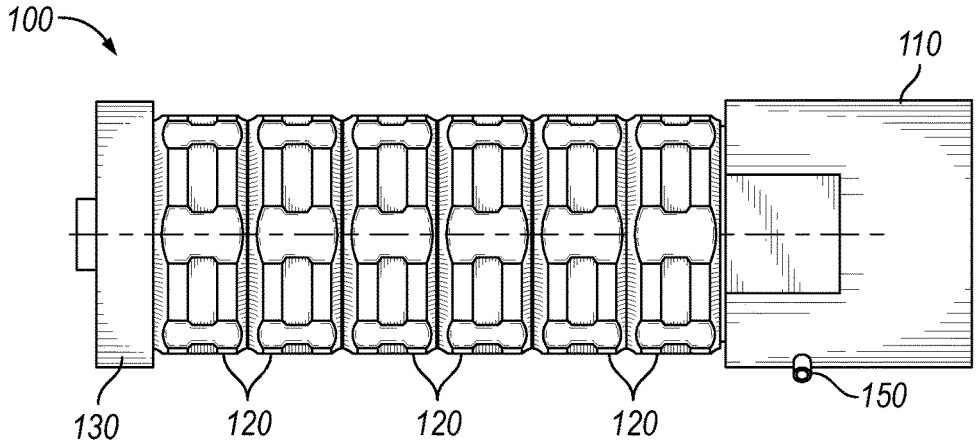
FIG. 11 is schematic of an embodiment of a firearm suppressor including a port to connect the initial chamber of the firearm suppressor to a remote chamber.

FIG. 11 is a schematic of a firearm suppressor 100 of FIG. 10 but does not includes the remote chamber 160 or tubing 170 for clarity. The firearm suppressor 100 is configured to be attached to a firearm 200 to reduce the noise during the discharge of the firearm 200 as would be appreciated by one of ordinary skill in the art having the benefit of this disclosure. The firearm suppressor 100 includes a base 110 and an end cap 130 with a plurality of baffles 120 positioned between the base 110 and the end cap 130. The base 110 is configured to attach the firearm suppressor 100 to the muzzle end of a firearm 200. The firearm suppressor 100 includes a projectile path through the length of the firearm suppressor 100 as would be appreciated by one of ordinary skill in the art having the benefit of this disclosure. The firearm suppressor 100 includes an exterior port 150 that enables communication between the initial chamber 140 of the firearm suppressor 100 and the remote suppressor 160 (shown in FIG. 10) via tubing 170 (shown in FIG. 10).

Figure 12:
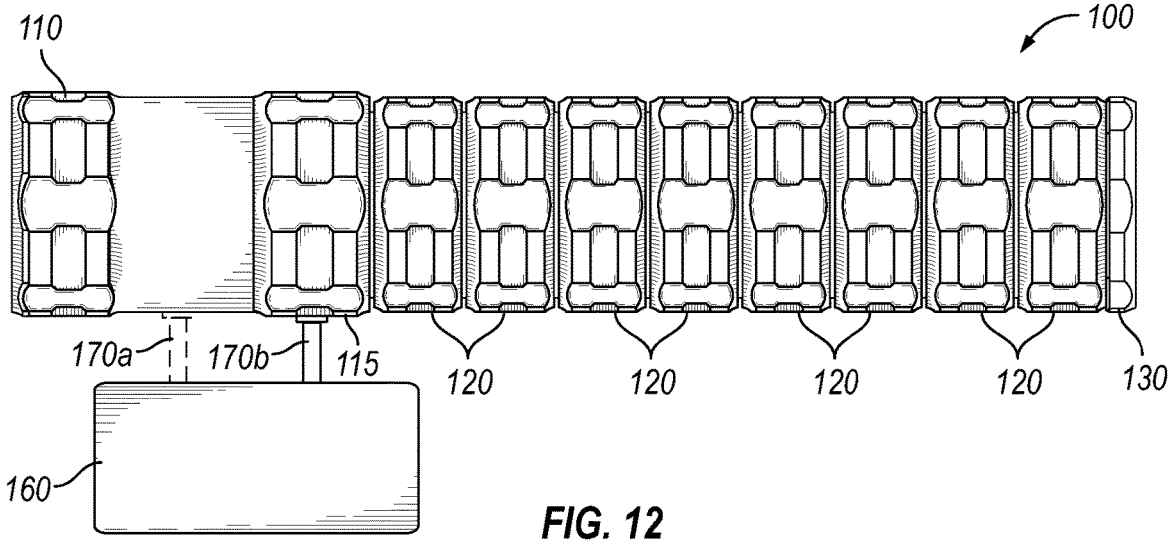
FIG. 12 is schematic of an embodiment of a firearm suppressor including a port to connect the initial chamber of the firearm suppressor to a remote chamber.

FIG. 12 is a schematic of a firearm suppressor 100 that includes a remote chamber 160. The firearm suppressor 100 is configured to be attached to a firearm 200 to reduce the noise during the discharge of the firearm as would be appreciated by one of ordinary skill in the art having the benefit of this disclosure. The firearm suppressor 100 includes a base 110, an adapter 115, an end cap 130, and a plurality of baffles 120 positioned between the adapter 115 and the end cap 130. The base 110 is configured to attach the firearm suppressor 100 to the muzzle end of a firearm 200. The firearm suppressor 100 includes a projectile path through the length of the firearm suppressor 100 as would be appreciated by one of ordinary skill in the art having the benefit of this disclosure.

The firearm suppressor 100 includes a remote chamber 160 that is in fluid communication with an initial chamber of the firearm suppressor 100. The initial chamber is positioned between the base 110 and the first baffle 120. It is believed that the highest pressure increase as well as highest temperature increase is exhibited in the initial chamber when a firearm 200 attached to the firearm suppressor 100 is discharged. The remote chamber 160 is in fluid communication with the initial chamber via tubing 170. Tubing 170 may be flexible or rigid as would be appreciated by one of ordinary skill in the art having the benefit of this disclosure. The tubing 170 is connected to an exterior port in the firearm suppressor 100. The exterior port provides communication between the initial chamber and the remote chamber 160 via the tubing 170. The exterior port may be through the adapter 115 to provide fluid communication between the initial chamber and the remote chamber 160 via tube 170*b*. Alternatively, the exterior port may be through the side of the base 110 of the firearm suppressor 100 to provide fluid communication between the initial chamber and the remote chamber 160 via tube 170*a*.

Figure 13:
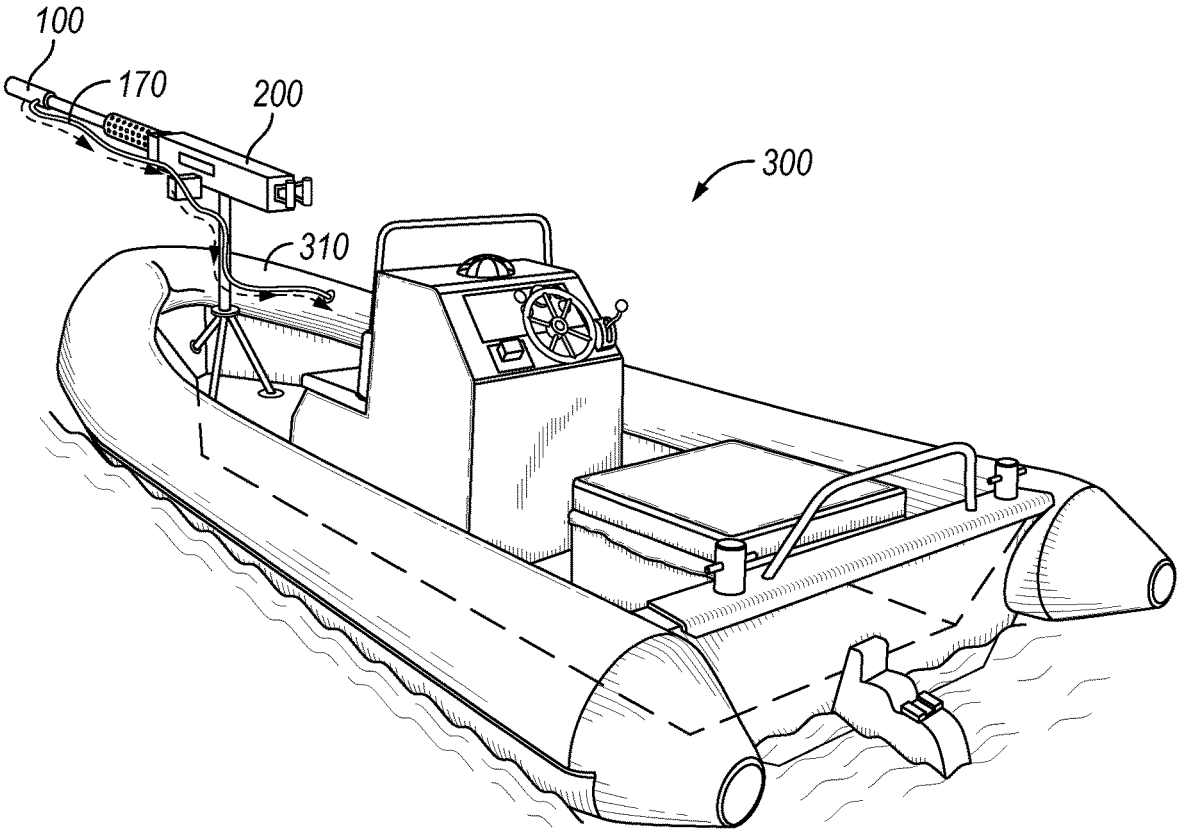
FIG. 13 is a schematic of an embodiment of a firearm suppressor having a remote chamber positioned within a vehicle

FIG. 13 is a schematic of an embodiment of a firearm suppressor 100 having a remote chamber (not shown) positioned within a vehicle 300. A firearm 200, which may be a vehicle-mounted firearm, includes a suppressor 100 configured to suppress the sound of the discharge of the firearm 200. The remote chamber is positioned within the side, or hull, 310 of the vehicle 300. The remote chamber 160 is connected to the suppressor 100 via a pathway 170, which may be flexible tubing. The vehicle 300 may be, but is not limited to, an automobile, aircraft, watercraft, a military vehicle, a law enforcement vehicle, or the like.

Figure 14:
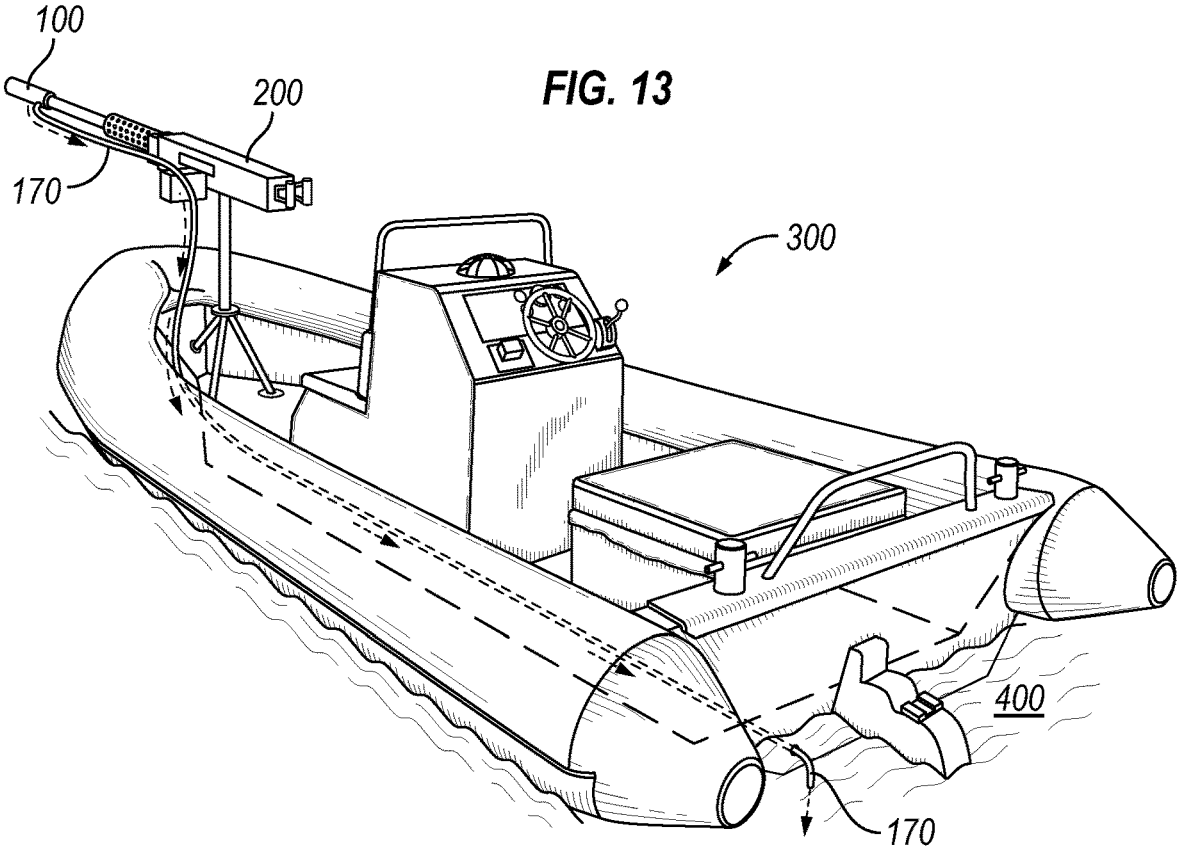
FIG. 14 is a schematic of an embodiment of a firearm suppressor that vents into water.

FIG. 14 is a schematic of an embodiment of a firearm suppressor 100 connected to a firearm 200 positioned within the vehicle 300. The firearm 200 may be a vehicle-mounted firearm and the suppressor 100 is configured to suppress the sound of the discharge of the firearm 200. An initial chamber of the firearm suppressor 100 may vent to water 400 via a pathway 170, which may be flexible tubing. The pathway 170 may pass through a remote chamber (not shown) within the vehicle 300 on the way to the water 400.

Figure 15:
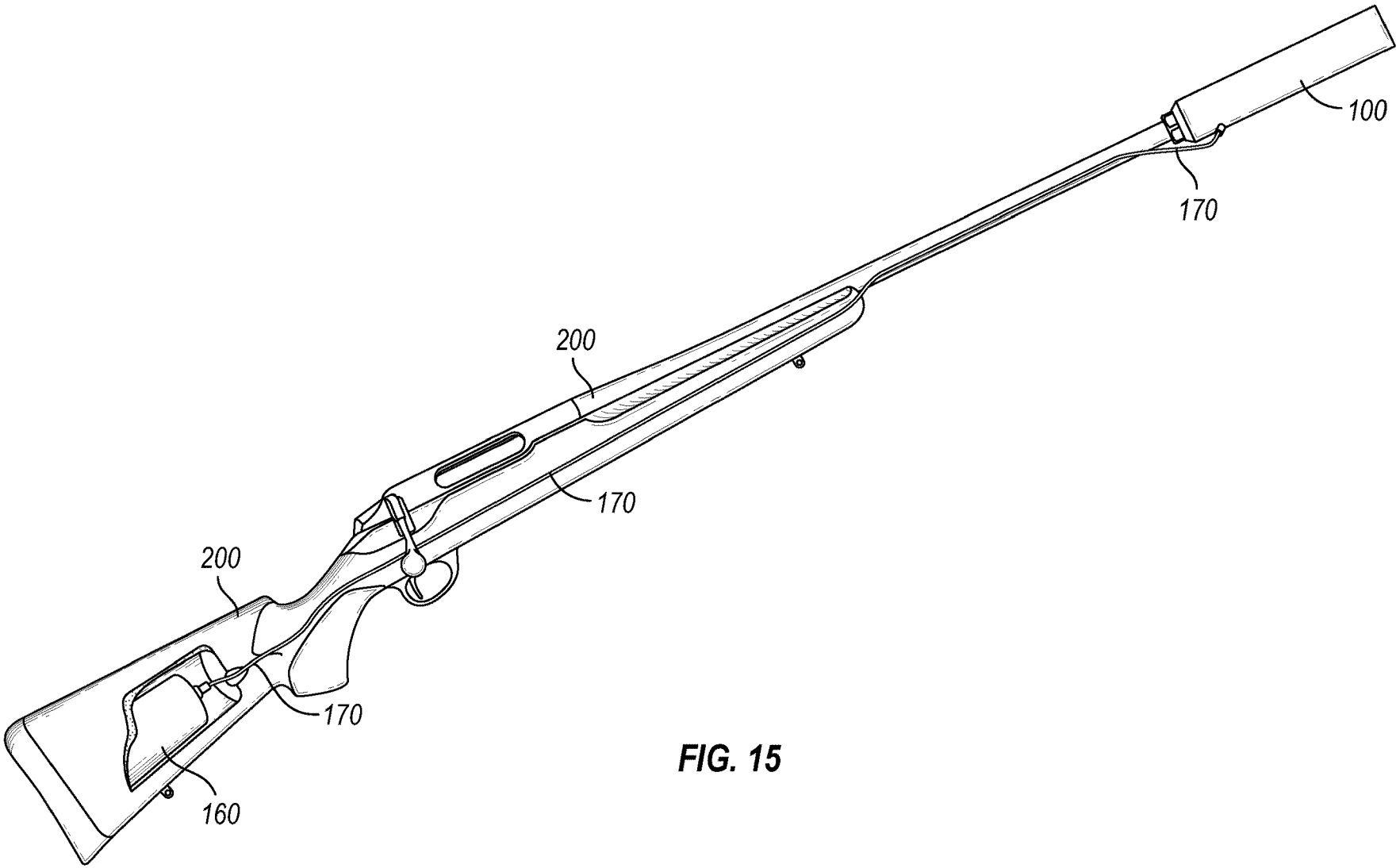
FIG. 15 is a schematic of an embodiment of a firearm suppressor having a remote chamber connected positioned within a stock of a firearm.

FIG. 15 is a schematic of a firearm 200 that includes a firearm suppressor 100 configured to suppress the discharge of the firearm 200. The firearm 200 includes a remote chamber 160 positioned within a stock 220 of the firearm 200. As discussed herein, the firearm suppressor 100 includes a remote chamber 160 that is in fluid communication with an initial chamber (not shown) of the firearm suppressor 100. It is believed that the highest pressure increase as well as highest temperature increase is exhibited in the initial chamber when the firearm 200 is discharged. The remote chamber 160 is in fluid communication with the initial chamber 140 via tubing 170. Tubing 170 may be flexible or rigid as would be appreciated by one of ordinary skill in the art having the benefit of this disclosure. The tubing 170 is connected to an exterior port in the firearm suppressor 100. The exterior port provides communication between the initial chamber and the remote chamber 160 via the tubing 170. The addition of a remote chamber 160 having a second volume enables the effective volume of the initial chamber to be enlarged without adding to the length, size, and/or weight of the suppressor being added to the end of the firearm. The remote chamber 160 may increase the effectiveness of the firearm suppressor 100 to suppress the discharge of the firearm 200.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A firearm suppressor comprising:

a base, the base configured to be connected to a barrel of a firearm, the base includes a projectile pathway through the base;

one or more baffles, the one or more baffles each include a central aperture;

an end cap having a central opening;

an exterior housing connected between the base and the end cap, wherein the one or more baffles are positioned within the exterior housing and wherein the exterior housing is a separate component from the base;

an initial chamber, the initial chamber being positioned between the base and a first baffle of the one or more baffles; and a remote chamber positioned exterior of the exterior housing, the remote chamber in fluid communication with the initial chamber to enable gas from the initial chamber to expand into the remote chamber and wherein the remote chamber is enclosed at one end.

2. The firearm suppressor of claim 1, the initial chamber having a first volume and the remote chamber having a second volume, wherein the first volume is substantially equal to the second volume.

3. The firearm suppressor of claim 1, the initial chamber having a first volume and the remote chamber having a second volume, wherein the second volume is more than twice as large as the first volume.

4. The firearm suppressor of claim 1, the initial chamber having a first volume and the remote chamber having a second volume, wherein the second volume is greater than 100 liters.

5. The firearm suppressor of claim 1, wherein the remote chamber is connected to the initial chamber via a flexible tube.

6. The firearm suppressor of claim 1, wherein the remote chamber is directly connected to a portion of the firearm.

7. The firearm suppressor of claim 1, wherein the remote chamber is positioned within a stock of the firearm.

8. The firearm suppressor of claim 1, wherein the remote chamber is connected to a vehicle.

9. The firearm suppressor of claim 8, wherein the vehicle is a watercraft.

10. The firearm suppressor of claim 1, wherein the remote chamber is wearable.

11. The firearm suppressor of claim 1, wherein the remote chamber further comprises a first remote chamber and further comprising a second remote chamber positioned exterior of the housing, the second remote chamber in fluid communication with the initial chamber.

12. The firearm suppressor of claim 1, wherein the remote chamber further comprises a relief valve.

13. The firearm suppressor of claim 12, wherein the relief valve is configured to release gas from the remote chamber when a pressure within the remote chamber exceeds a predetermined pressure.

14. The firearm suppressor of claim 13, wherein the predetermined pressure is between 25 pound-force per square inch (PSI) and 50 PSI.

15. A firearm suppressor comprising:

a base, the base configured to be connected to a barrel of a firearm, the base includes a first projectile pathway through the base;

one or more baffles, the one or more baffles each include a central aperture;

an end cap having a central opening, the one or more baffles positioned between the base and the end cap;

an initial chamber, the initial chamber being positioned between the base and a first baffle of the one or more baffles; and a remote chamber, the remote chamber in fluid communication with the initial chamber to enable gas from the initial chamber to expand into the remote chamber, wherein the entire remote chamber is not positioned between the base and the end cap and wherein the remote chamber is enclosed at one end.

16. The firearm suppressor of claim 15, further comprising an adapter positioned between the base and the one or more baffles, the adapter includes a second projectile pathway through the adapter that is aligned with the first projectile pathway and wherein the initial chamber is positioned between the adapter and the first baffle of the one or more baffles.

17. The firearm suppressor of claim 15, wherein the remote chamber is connected to the initial chamber via a tube.

18. The firearm suppressor of claim 15, wherein the remote chamber is connected to a portion of the firearm via an accessory rail.

19. A firearm suppressor comprising:

one or more baffles, the one or more baffles each include a central aperture configured to be aligned with a centerline of a barrel of a firearm;

an initial chamber, the initial chamber being positioned between a first baffle of the one or more baffles and a muzzle end of the barrel of the firearm; and an exterior port in fluid communication with the initial chamber, wherein the exterior port is not aligned with the centerline of the barrel of the firearm; and a remote chamber in fluid communication with the exterior port to enable gas from the initial chamber to expand into the remote chamber, wherein the remote chamber is enclosed at one end;

a flexible tube connected between the exterior port and the remote chamber; and a relief valve connected to the remote chamber, wherein the relief valve is configured to release gas from the remote chamber when a pressure within the remote chamber exceeds a predetermined pressure.

* * * * *